US010657939B2

(12) United States Patent
Ichiki

(10) Patent No.: US 10,657,939 B2
(45) Date of Patent: May 19, 2020

(54) KEYBOARD APPARATUS AND ELECTRONIC KEYBOARD INSTRUMENT

(71) Applicant: YAMAHA CORPORATION, Hamamatsu-shi (JP)

(72) Inventor: Shunsuke Ichiki, Hamamatsu (JP)

(73) Assignee: YAMAHA CORPORATION, Hamamatsu-shi (JP)

( * ) Notice: Subject to any disclaimer, the term of this patent is extended or adjusted under 35 U.S.C. 154(b) by 0 days.

(21) Appl. No.: 16/133,756

(22) Filed: Sep. 18, 2018

(65) Prior Publication Data

US 2019/0035371 A1 Jan. 31, 2019

Related U.S. Application Data

(63) Continuation of application No. PCT/JP2017/009165, filed on Mar. 8, 2017.

(30) Foreign Application Priority Data

Mar. 25, 2016 (JP) ..... 2016-061657

(51) Int. Cl.
*G10H 1/34* (2006.01)
*G10B 3/12* (2006.01)

(52) U.S. Cl.
CPC ..... *G10H 1/34* (2013.01); *G10B 3/12* (2013.01); *G10H 2220/221* (2013.01); *G10H 2220/275* (2013.01)

(58) Field of Classification Search
CPC ..... G10H 1/34; G10B 3/12; G10C 3/12
See application file for complete search history.

(56) References Cited

U.S. PATENT DOCUMENTS 2,466,511 A * 4/1949 Swanson ..... G10C 3/12 84/434
2,612,812 A * 10/1952 Swanson ..... G10B 3/12 84/433
2,832,251 A * 4/1958 Hayslett ..... G10C 3/12 84/433

(Continued)

FOREIGN PATENT DOCUMENTS

JP H0331799 U 3/1991
JP 2008070417 A 3/2008
JP 2008191650 A 8/2008

OTHER PUBLICATIONS

International Search Report issued in Intl. Appln. No. PCT/JP2017/009165 dated May 16, 2017. English translation provided.

(Continued)

*Primary Examiner* — Robert W Horn
(74) *Attorney, Agent, or Firm* — Rossi, Kimms & McDowell LLP

(57) ABSTRACT

A keyboard apparatus includes: keys; at least one frame configured to support at least one of the keys; at least one bendable portion disposed between one of the keys and the frame and having flexibility in a scale direction; and a coupler configured to couple the bendable portion and the key to each other attachably and detachably. Two couplers each as the coupler which correspond respectively to the keys adjacent to each other are disposed respectively at positions different from each other in a longitudinal direction of the key.

11 Claims, 10 Drawing Sheets

(56) References Cited

U.S. PATENT DOCUMENTS 2,848,920 A * 8/1958 Lester ..... G10H 1/0558 84/720
3,330,176 A * 7/1967 Schwartz ..... G10B 3/12 84/433
3,480,744 A * 11/1969 Yamada ..... G10H 1/344 200/1 A
3,616,722 A * 11/1971 Hochleitner ..... G10C 3/12 84/354
3,738,216 A * 6/1973 Slaats ..... G10C 3/12 84/433
4,043,244 A * 8/1977 Schrecongost ..... G10C 3/12 84/423 R
4,129,057 A * 12/1978 Hoshi ..... G10C 3/12 84/434
4,278,004 A * 7/1981 Klann ..... G10C 3/14 84/227
4,418,605 A * 12/1983 Tollefsen ..... G10C 3/12 200/5 R
4,479,415 A * 10/1984 Haberstumpf ..... G10B 3/12 84/423 R
4,892,024 A * 1/1990 Watanabe ..... G10H 1/344 84/423 R
6,657,143 B2 * 12/2003 Nagashima ..... G10H 1/344 200/283
10,262,637 B1 * 4/2019 Salerno ..... G10H 1/344
2019/0035371 A1 * 1/2019 Ichiki ..... G10B 3/12

OTHER PUBLICATIONS

Written Opinion issued in Intl. Appln. No. PCT/JP2017/009165 dated May 16, 2017. English translation provided.
International Preliminary Report on Patentability issued in Intl. Appln. No. PCT/JP2017/009165 dated Sep. 25, 2018. English translation provided.

* cited by examiner

KEYBOARD APPARATUS AND ELECTRONIC KEYBOARD INSTRUMENT

CROSS REFERENCE TO RELATED APPLICATION

The present application is a continuation application of International Application No. PCT/JP2017/009165, filed on Mar. 8, 2017, which claims priority to Japanese Patent Application No. 2016-061657, filed on Mar. 25, 2016. The contents of these applications are incorporated herein by in their entirety.

BACKGROUND

The present disclosure relates to techniques for a keyboard apparatus and an electronic keyboard instrument using the keyboard apparatus.

Patent Document 1 (Japanese Patent Application Publication No. 2008-191650) discloses a technique relating to a keyboard apparatus including: a key; a horizontal hinge portion connected from the key in a key-longitudinal back direction; and a vertical hinge portion connected from the horizontal hinge portion in the key-longitudinal back direction.

SUMMARY

In this technique, in the case where the key is coupled to the frame, the coupler requires a large width in a scale direction, leading to a possibility of contact between the couplers when the key is moved in the scale direction.

It is therefore an object of the present disclosure to provide a keyboard apparatus configured to reduce contact between couplers in a case where a configuration in which keys are coupled to a frame is employed.

An aspect of the present disclosure relates to a keyboard apparatus includes: a plurality of keys; at least one frame configured to support at least one of the keys; at least one bendable portion disposed between one of the keys and the frame and having flexibility in a scale direction; and a coupler configured to couple the bendable portion and the key to each other attachably and detachably, wherein two couplers each as the coupler which correspond respectively to the keys adjacent to each other are disposed respectively at positions different from each other in a longitudinal direction of the key.

Another aspect of the present disclosure relates to an electronic keyboard instrument including: a keyboard apparatus including (i) a plurality of keys, (ii) at least one frame configured to support at least one of the keys, (iii) at least one bendable portion disposed between one of the keys and the frame and having flexibility in a scale direction, and (iv) a coupler configured to couple the bendable portion and the key to each other attachably and detachably, wherein two couplers each as the coupler which correspond respectively to the keys adjacent to each other are disposed respectively at positions different from each other in a key longitudinal direction of the key; a sensor configured to detect operation for the key; and a sound source section configured to produce a sound waveform signal in response to a signal output by the sensor.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENT

Hereinafter, there will be described an electronic keyboard instrument 500 according to one embodiment of the present disclosure by reference to the drawings. It is to be understood that the following embodiment is one example of the embodiment of the present disclosure, and the present disclosure is not limited to the embodiment.

1. Overall Configuration

Figure 1:
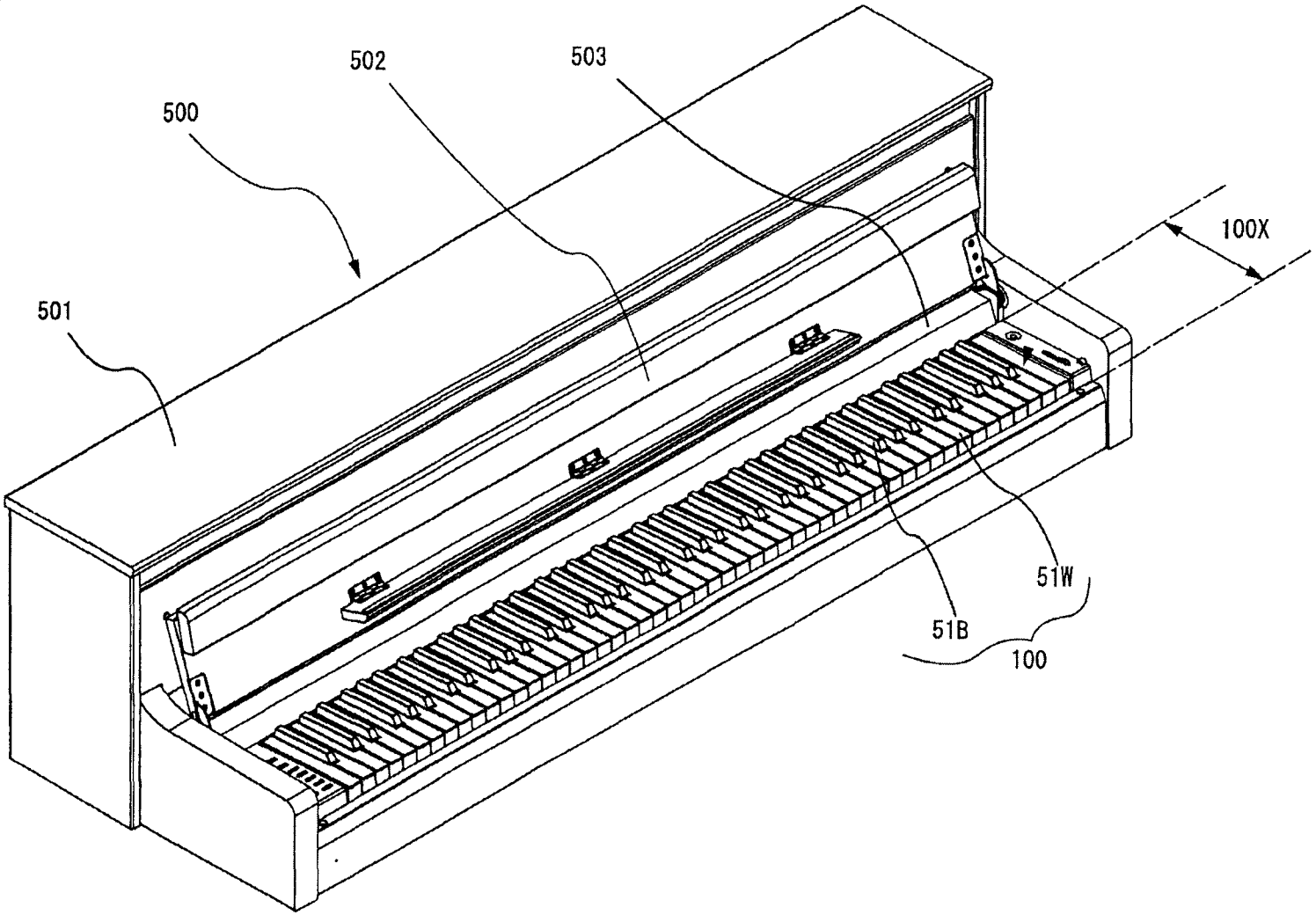
FIG. 1 is a perspective view of an electronic keyboard instrument including a keyboard apparatus according to one embodiment of the present disclosure.

FIG. 1 is a perspective view of the electronic keyboard instrument 500 including a keyboard apparatus 100 according to one embodiment of the present disclosure. As illustrated in FIG. 1, the electronic keyboard instrument 500 includes: a housing 501; the keyboard apparatus 100 including white keys 51W and black keys 51B; a cover 502; and a cover 503.

The keyboard apparatus 100 is installed on the housing 501. The cover 502 is openable and closable with respect to the housing 501. When being in a closed state, the cover 502 covers the entire keyboard apparatus 100. The cover 503 is immovably secured to the housing 501 and is configured to cover a portion of the keyboard apparatus 100. The keyboard apparatus 100 includes: a visible portion 100X not to be covered with the cover 503; and a non-visible portion 100Y (see FIG. 2) to be covered with the cover 503.

Figure 2:
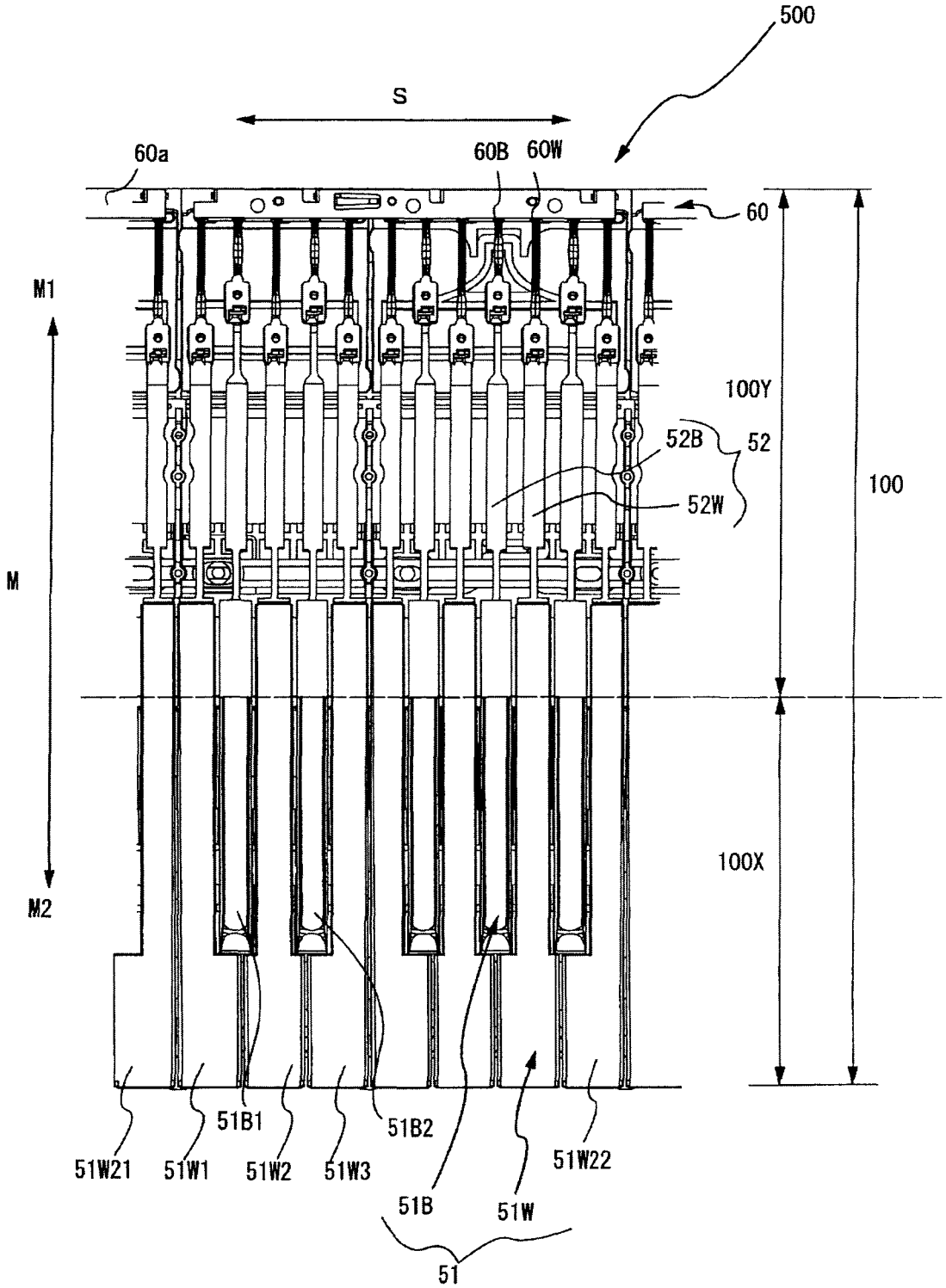
FIG. 2 is an enlarged view of a portion of the electronic keyboard instrument.

FIG. 2 is an enlarged view of a portion of the electronic keyboard instrument 500. In the following explanation, a direction directed from the near side toward the far side for a user in a key longitudinal direction M in the keyboard apparatus 100 will be referred to as "key-longitudinal back direction M1", and a direction directed from the far side toward the near side for the user in the key longitudinal direction M will be referred to as "key-longitudinal front direction M2".

In the keyboard apparatus 100, the keys 51 (the white keys 51W and the black keys 51B), connectors 52 (white-key connectors 52W and black-key connectors 52B), and a frame 60 are arranged in this order in the key longitudinal direction M. Each of the keys 51 is a component to be depressed by the user. Each of the connectors 52 extends from a corresponding one of the keys 51 in the key-longitudinal back direction M1 and is connected between the corresponding key 51 and the frame 60. A plurality of sets of the keys 51 and the connectors 52 respectively coupled to each other are arranged in a scale direction S.

The frame 60 is disposed on a key-longitudinal-back-direction-M1 side of the connectors 52 in the key longitudinal direction M. The frame 60 includes a supporter 60*a*, a plurality of frame narrow portions 60W, and a plurality of frame narrow portions 60B. The supporter 60*a* extends in the scale direction S and supports the frame narrow portions 60W and the frame narrow portions 60B. Each of the frame narrow portions 60W and the frame narrow portions 60B extends from the supporter 60*a* in a direction substantially orthogonal to the scale direction S (the key longitudinal direction M).

Portions of the keys 51 which correspond to the visible portion 100X of the keyboard apparatus 100 are disposed at a region viewable from the outside (also see FIG. 1). The connectors 52 and the other portions of the keys 51 which correspond to the non-visible portion 100Y of the keyboard apparatus 100 are disposed at a region covered with the cover 503 and not viewable from the outside (also see FIG. 1).

2. White Keys

The white keys 51W include a white key 51W21 (a first key) and a white key 51W22 (a second key) having the same shape. For example, the white key 51W21 (the first key) and the white key 51W22 (the second key) are different from each other by one octave and have the same shape. Thus, since the white key 51W21, 51W22 have the same shape, one white key may also be used for another white key corresponding to another octave.

3. Black Keys

The black keys 51B include a black key 51B1 (the first key) and a black key 51B2 (the second key) having the same shape. For example, the black key 51B1 (the first key) and the black key 51B2 (the second key) are arranged with one or two white keys 51W interposed therebetween and have the same shape. Thus, since the black keys 51B have the same shape, the black key may be used any position of the black key.

4. Frame

Figure 3:
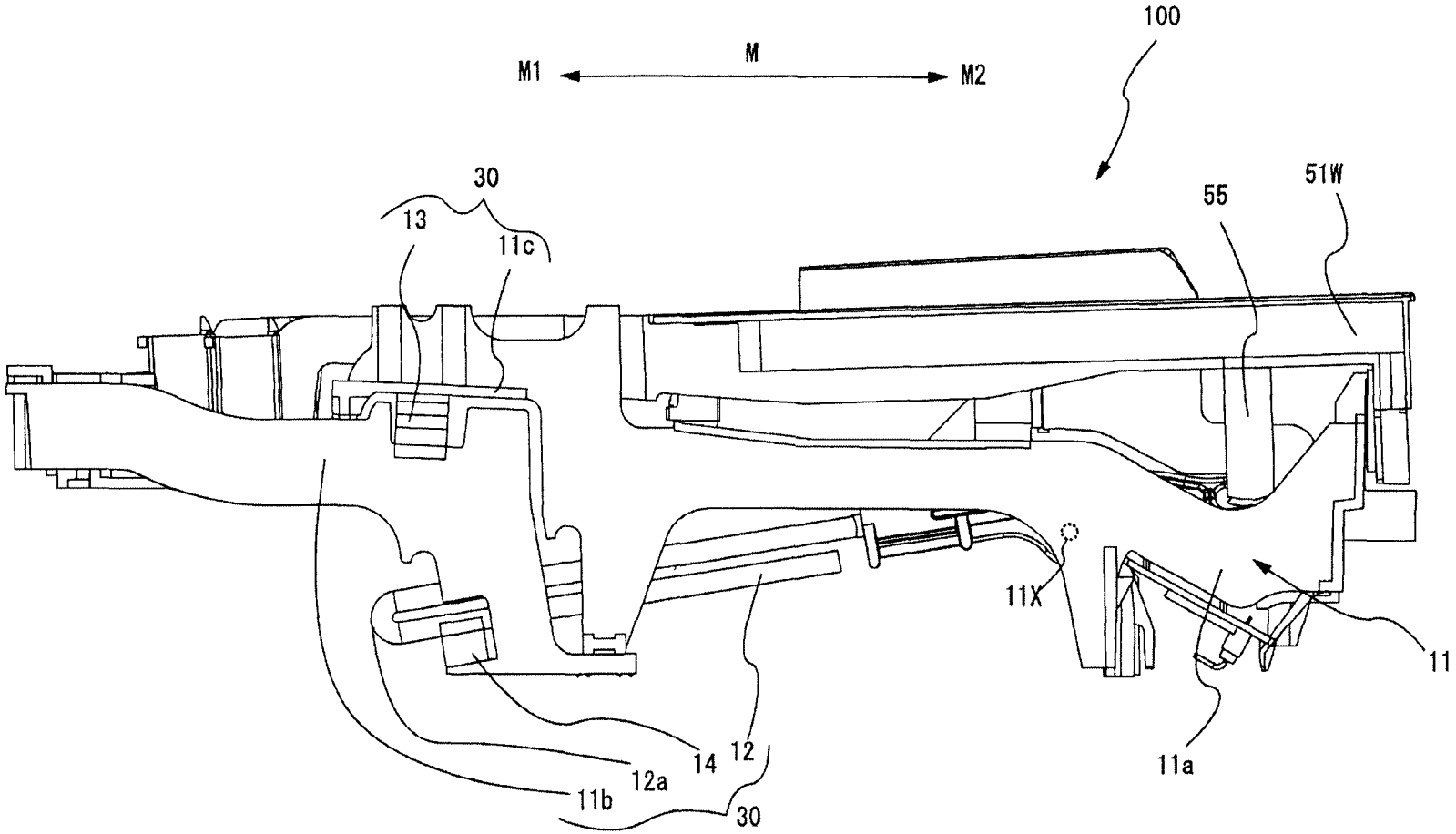
FIG. 3 is a side view of the keyboard apparatus.

FIG. 3 is a side view of the keyboard apparatus 100, with the white key 51W being viewed from a lateral side. As illustrated in FIG. 3, a frame 11 includes a support frame portion 11*a*, a support frame portion 11*b*, and a support frame portion 11*c*. The support frame portion 11*b* and the support frame portion 11*c* are secured to the support frame portion 11*a*. The support frame portions 11*a*-11*c* are connected to each other immovably relative to each other.

4.1. Support Frame Portion 11*a*

The support frame portion 11*a* includes a pivot shaft 11X and supports a hammer 12 such that the hammer 12 is pivotable. The hammer 12 pivots about the pivot shaft 11X (indicated by the broken line in FIG. 3). The hammer 12 is configured such that, when a pressing portion 55 extending downward from the white key 51W is moved downward, a basal end portion 12*b* (see FIG. 8) of the hammer 12 on a key-longitudinal-front-direction-M2-side is moved downward, and a distal end portion 12*a* of the hammer 12 on the key-longitudinal-back-direction-M1 side is moved upward.

4.2. Support Frame Portion 11*b*

The support frame portion 11*b* supports a supporter 14. The supporter 14 stops and supports, from below, the distal end portion 12*a* of the hammer 12 moving downward by gravity when the white key 51W is in a non-depressed state. The supporter 14 extends in the scale direction S. The hammer 12 is set such that a portion of the hammer 12 on the key-longitudinal-back-direction-M1 side of the pivot shaft 11X is longer than a portion of the hammer 12 on the key-longitudinal-front-direction-M2-side of the pivot shaft 11X. Accordingly, in the non-depressed state, the distal end portion 12*a* of the hammer 12 is located on a lower side of the pivot shaft 11X due to gravity. The supporter 14 defines a lower limit of a range of pivotal movement of the distal end portion 12*a* of the hammer 12.

4.3. Support Frame Portion 11*c*

The support frame portion 11*c* supports a hammer stopper 13. The hammer stopper 13 contacts the distal end portion 12*a* of the hammer 12 which moves upward when the white key 51W is in the depressed state (FIG. 8B). Each of the hammer stopper 13 and the support frame portion 11*c* extends in the scale direction S.

5. Keys and Connectors

Figures 4A, 4B, 4C:
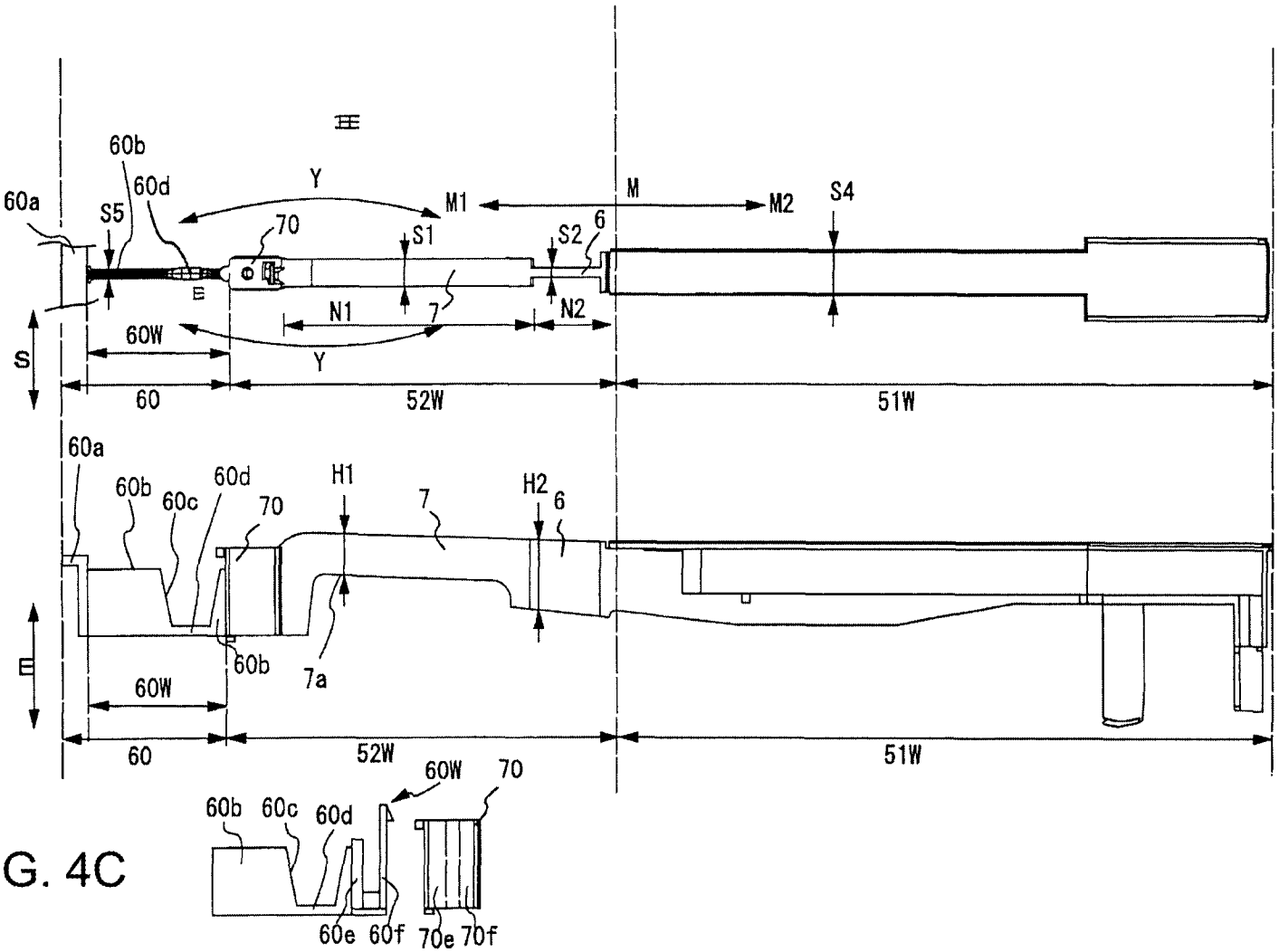
FIG. 4A is a plan view of a white key.
FIG. 4B is a side view of the white key.
FIG. 4C is a side view of a portion of a configuration of one of couplers 70 and a corresponding one of the frame narrow portions 60W before their coupling.
Figure 5A:
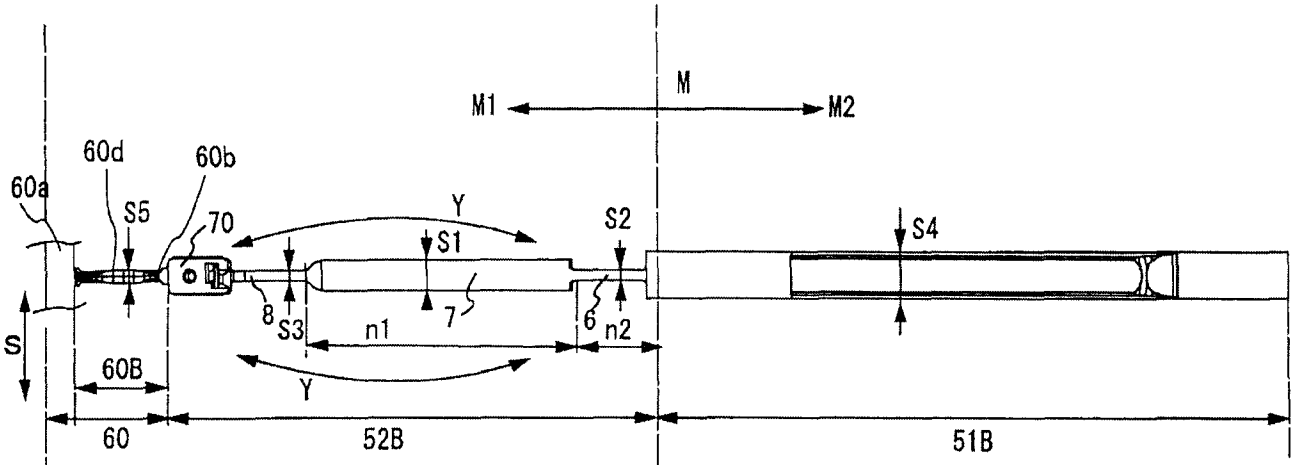
FIG. 5A is a plan view of a black key.
Figure 5B:
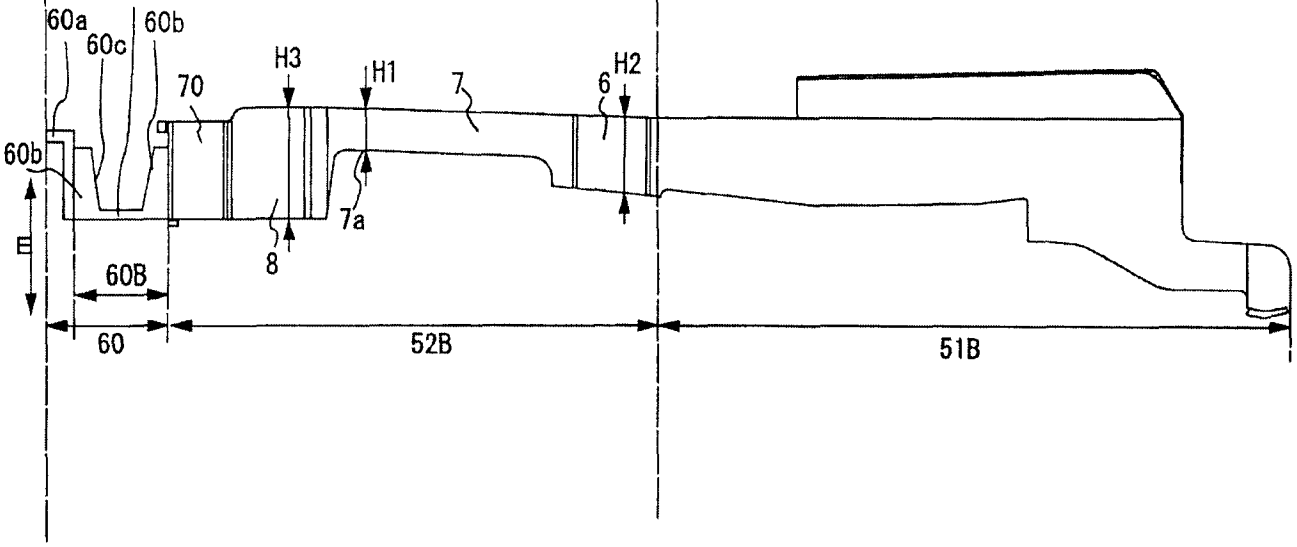
FIG. 5B is a side view of the black key.

FIG. 4A is a plan view of the white key 51W, and FIG. 4B is a side view of the white key 51W. FIG. 4C is a side view of a portion of a configuration of one of couplers 70 and a corresponding one of the frame narrow portions 60W before their coupling. FIG. 5A is a plan view of the black key 51B, and FIG. 5B is a side view of the black key 51B. Each of the white-key connectors 52W connected to the respective white keys 51W includes a front narrow portion 6 (a second region), a wide portion 7 (a first region), and the coupler 70. The frame 60 includes the frame narrow portions 60W. Likewise, each of the black-key connectors 52B connected to the respective black keys 51B includes the front narrow portion 6 (the second region), the wide portion 7 (the first region), and a back narrow portion 8 (the second region). The frame 60 includes the frame narrow portions 60B. The following description is provided, focusing on the white keys 51W.

5.1. White Keys

Each of the frame narrow portions 60W includes: a bendable portion 60*b* (the second region) extending from the supporter 60*a* and flexible in the scale direction S; and a bendable portion 60*d* (a hinge) flexible in both of the scale direction S and a vertical direction E. Here, a portion of the frame narrow portion 60W which is different from the bendable portion 60*d* corresponds to the bendable portion 60*b*, and a cutout portion 60*c* corresponds to a portion of edges of the bendable portion 60*b* and the bendable portion 60*d*. The key 51 and the connector 52 are pivotable from a portion of the bendable portion 60*d* in the vertical direction E (see FIGS. 4B and 5B).

It is noted that the frame narrow portion 60W and the coupler 70 illustrated in FIG. 4C are coupled to each other. For this coupling, a first inserted portion 60*e* of the frame narrow portion 60W is inserted in an insertion opening 70*e* of the coupler 70, and a second inserted portion 60*f* of the frame narrow portion 60W is inserted in an insertion opening 70*f* of the coupler 70. The attaching and detaching mechanism in FIG. 4C is also applied to an attaching and detaching mechanism of the frame narrow portion 60B and the coupler 70 for the black key 51B.

Since the bendable portion 60*b* has a flat surface extending in the direction substantially orthogonal to the scale direction S, the bendable portion 60*b* is flexible in the scale direction S and bendable in the scale direction S. The bendable portion 60*d* is flexible in the scale direction S and bendable in the scale direction S and also is flexible in the vertical direction E and bendable in the vertical direction E. Accordingly, it is possible to consider that the bendable portion 60*d* is flexible in the pivotal direction of the key 51. Thus, the frame 60 provides a pivotal-movement function of the key 51. As a result, the configuration of the keyboard apparatus 100 is simplified.

5.1.1. Front Narrow Portion

The front narrow portion 6 (also referred to as "second region", "first narrow portion", or "first low-stiffness portion") extends from the white key 51W in the key-longitudinal back direction M1. The width S2 of the front narrow portion 6 in the scale direction S is less than the width S4 of the white key 51W in the scale direction S. The width S2 of the front narrow portion 6 in the scale direction S is less than the thickness H2 of the front narrow portion 6 in the vertical direction E. Briefly, the front narrow portion 6 is disposed such that a thin plate-like member is oriented vertically.

Thus, since the width S2 of the front narrow portion 6 in the scale direction S is small, the stiffness of the front narrow portion 6 in the scale direction S is less than that of the white key 51W in the scale direction S, and accordingly the front narrow portion 6 is flexible in the scale direction S and in a yawing direction Y and easily bendable. The configuration of the front narrow portion 6 is the same in the case of the black keys 51B and in the case of the white keys 51W.

5.1.2. Wide Portions

The wide portion 7 (also referred to as "first region" or "high-stiffness portion") extends in the key-longitudinal back direction M1 from the front narrow portion 6 located near the white key 51W. The width S1 of the wide portion 7 in the scale direction S is greater than the width S2 of the front narrow portion 6 in the scale direction S.

Since the width 51 of the wide portion 7 in the scale direction S is large, the stiffness of the wide portion 7 in the scale direction S is greater than that of the front narrow portion 6 in the scale direction S. It is noted that the width 51 of the wide portion 7 in the scale direction S is less than the width S4 of the key 51 in the scale direction S.

The wide portion 7 has a recessed portion 7*a* that is recessed upward in side view. Though the recessed portion 7*a* reduces the stiffness of the wide portion 7, the recessed portion 7*a* has the width S1 greater than the width of the front narrow portion 6, and accordingly the recessed portion 7*a* has high stiffness. The front narrow portion 6 and the frame narrow portions 60W only need to be formed in at least a portion of a region different from the recessed portion 7*a*.

It is noted that the width S1 of the wide portion 7 in the scale direction S is less than the thickness H1, in the vertical direction E, of a thin portion of the wide portion 7 due to the recessed portion 7*a* formed therein. Briefly, the wide portion 7 is disposed such that a thin plate-like member is oriented vertically. The thickness H1 of the wide portion 7 in the vertical direction E is less than the thickness H2 of the front narrow portion 6 in the vertical direction E.

5.2. Black Keys

There will be next described the black keys 51B with reference to FIGS. 5A and 5B.

The configuration of the wide portion 7 is similar in the case of the black keys 51B and in the case of the white keys 51W. However, the length n1, in the key longitudinal direction M, of the wide portion 7 of the black-key connector 52B connected to the black key 51B is less than the length N1 of the wide portion 7 of the white key 51W in the key longitudinal direction M. This is partly because the black key 51B is less than the white key 51W in length in the key longitudinal direction M. Independently of the black-key connectors 52B and the white-key connectors 52W, each of the lengths n1, N1 of the wide portion 7 in the key longitudinal direction M is greater than a corresponding one of the lengths n2, N2 of the front narrow portion 6 in the key longitudinal direction M.

5.2.1. Back Narrow Portion

There will be next described the back narrow portions 8 of the respective black-key connectors 52B. The back narrow portion 8 (also referred to as "second region", "second narrow portion", or "second low-stiffness portion") extends from the wide portion 7 in the key-longitudinal back direction M1. The width S3 of the back narrow portion 8 in the scale direction S is less than each of the width S1 of the wide portion 7 in the scale direction S and the width S4 of the key 51B in the scale direction S. The width S3 of the back narrow portion 8 in the scale direction S is less than the thickness H3 of the back narrow portion 8 in the vertical direction E. Briefly, the back narrow portion 8 is disposed such that a thin plate-like member is oriented vertically.

Thus, it is possible to consider that the back narrow portion 8 has a shape in which, since its width S3 in the scale direction S is small, the stiffness of the back narrow portion 8 in the scale direction S is less than that of the wide portion 7 in the scale direction S, and accordingly the back narrow portion 8 is flexible in the scale direction S and in the yawing direction Y and easily bendable in the scale direction S.

In the present embodiment, the width S3 of the back narrow portion 8 in the scale direction S is substantially equal to the width S2 of the front narrow portion 6 in the scale direction S. However, the width S3 of the back narrow portion 8 in the scale direction S may be greater or less than the width S2 of the front narrow portion 6 in the scale direction S.

As described above, the width S2 of the front narrow portion 6 in the scale direction S may be less than the width S1 of the wide portion 7 in the scale direction S. Accordingly, the stiffness of the front narrow portion 6 in the scale direction S is less than that of the wide portion 7 in the scale direction S, and accordingly the front narrow portion 6 is flexible in the scale direction S and in the yawing direction Y and easily bendable. The width S1 of the wide portion 7 in the scale direction S is greater than each of the width S3 of the back narrow portion 8 in the scale direction S and the width S5 of each of the frame narrow portions 60W, 60B in the scale direction S. Accordingly, the stiffness of the wide portion 7 in the scale direction S is greater than that of the back narrow portion 8 in the scale direction S. The thickness H1 of the wide portion 7 in the vertical direction E is less than the thickness H3 of the back narrow portion 8 in the vertical direction E.

In the case of the white key 51W in the present embodiment, the front narrow portion 6 is disposed on the key-longitudinal-front-direction-M2-side (the near side) of the wide portion 7, and the frame narrow portions 60W is disposed on the key-longitudinal-back-direction-M1 side (the far side) of the wide portion 7. When the white key 51W is deformed in the yawing direction Y, a positional relationship between the connector 52 (see FIG. 2) and the frame 60 changes. The front narrow portion 6 and the frame narrow portion 60W have a function of reducing the effects of the change in the positional relationship by deformation of the front narrow portion 6 and the frame narrow portion 60W.

In the case of the black key 51B in the present embodiment, the front narrow portion 6 is disposed on the key-longitudinal-front-direction-M2-side (the near side) of the wide portion 7, and the back narrow portion 8 and the frame narrow portions 60B are disposed on the key-longitudinal-back-direction-M1 side (the far side) of the wide portion 7. When the black key 51B is deformed in the yawing direction Y, a positional relationship between the connector 52 (see FIG. 2) and the frame 60 changes. The front narrow portion 6, the back narrow portion 8, and the frame narrow portions 60B have a function of reducing the effects of the change in the positional relationship by deformation of the front narrow portion 6, the back narrow portion 8, and the frame narrow portions 60B.

As described above, in the case of the white key 51W, the coupler 70 is disposed between the wide portion 7 and the frame narrow portion 60W in the key longitudinal direction M. In the case of the black key 51B, the coupler 70 is disposed between the back narrow portion 8 and the frame narrow portion 60B in the key longitudinal direction M. There is such a difference between the white key 51W and the black key 51B. However, the length of the frame narrow portion 60W in the key longitudinal direction M is substantially equal to the sum of the lengths of the back narrow portion 8 and the frame narrow portions 60B in the key longitudinal direction M.

5.3. Attachment and Detachment of Connector

In the case of the white key 51W, the front narrow portion 6, the wide portion 7, the coupler 70, and the frame narrow portion 60W are arranged in this order in the key longitudinal direction M. The front narrow portion 6, the wide portion 7, and the couplers 70 are formed as a unit. The coupler 70 formed integrally with the wide portion 7 is coupled to the frame narrow portion 60W attachably and dettachably.

In the case of the black key 51B, the front narrow portion 6, the wide portion 7, the back narrow portion 8, the coupler 70, and the frame narrow portion 60B are arranged in this order in the key longitudinal direction M. The front narrow portion 6, the wide portion 7, the back narrow portion 8, and the coupler 70 are formed as a unit. The coupler 70 formed integrally with the back narrow portion 8 is coupled to the frame narrow portion 60B attachably and dettachably. The back narrow portion 8 is located on the key-longitudinal-front-direction-M2-side of the coupler 70, and the frame narrow portion 60B is located on the key-longitudinal-back-direction-M1 side of the coupler 70.

The coupler 70 is attached and detached by its sliding movement with the key 51 and the bendable portion 60*b* in the up and down direction. This configuration enables the coupler 70 to be attached and detached only by its sliding movement, resulting in improved workability in manufacture of the keyboard apparatus 100. Also, the mechanical strength is improved, thereby improving the durability of the keyboard apparatus 100 against an external force produced when the key is depressed.

6. Arrangement in Connector

Figure 6:
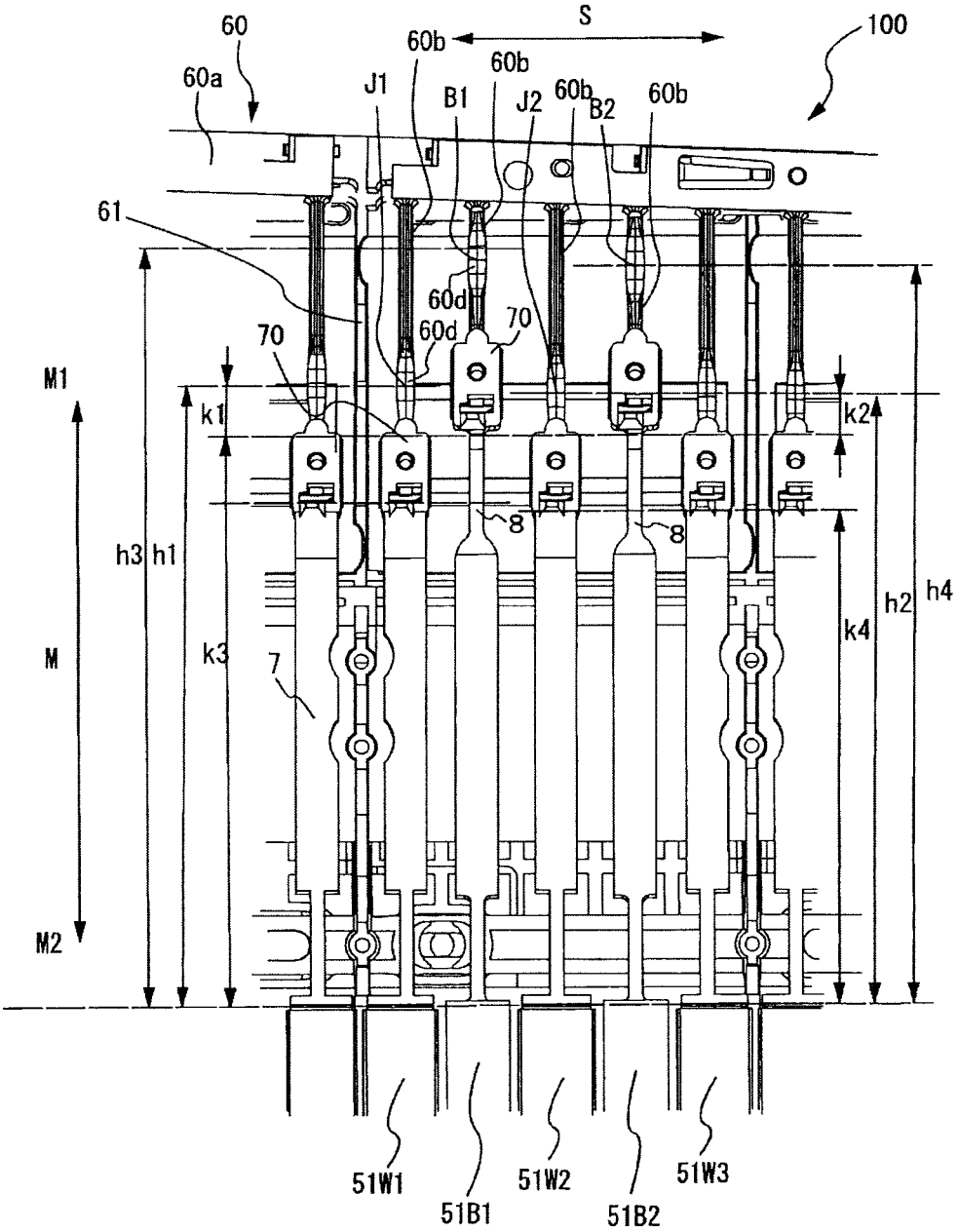
FIG. 6 is an enlarged view of a portion of the keyboard apparatus.

FIG. 6 is an enlarged view of a portion of the keyboard apparatus 100, illustrating the configurations of the couplers 70, the bendable portions 60*b*, and the frame 60. In FIG. 6, the frame 60 is slightly inclined with respect to the scale direction S so as to extend in the lower right direction, but this illustration exaggerates the inclination for emphasis. That is, the distance between the supporter 60*a* and the key 51 is smaller on a high-pitched-sound side than on a low-pitched sound side.

6.1. Pivot Center

As illustrated in FIG. 6, the pivot center J1 of the bendable portion 60*b* for a white key 51W1 corresponding to a low-pitched sound is located farther from the white keys 51W1, 51W2 in the key longitudinal direction M of the white key 51W than the pivot center J2 of the bendable portion 60*b* for a white key 51W2 corresponding to a high-pitched sound. That is, the distance h1 between the pivot center J1 of the white key 51W1 corresponding to the low-pitched sound and the white key 51W1 is greater than the distance h2 between the pivot center J2 of the white key 51W2 corresponding to the high-pitched sound and the white key 51W2.

The distance k1 between a first coupler 70 corresponding to the white key 51W1 and the pivot center J1 of the white key 51W1 is different from the distance k2 between a second coupler 70 corresponding to the white key 51W2 and the pivot center J2 of the white key 51W2. Thus, making the distance k1 and the distance k2 different from each other is only required to make the distance h1 between the pivot center J1 of the white key 51W1 and the white key 51W1 and the distance h2 between the pivot center J2 of the white key 51W2 and the white key 51W2 different from each other.

The pivot center B1 of the bendable portion 60*b* for the black key 51B1 corresponding to a low-pitched sound is farther from the black keys 51B1, 51B2 in the key longitudinal direction M of the black key 51B1 than the pivot center B2 of the bendable portion 60*b* for the black key 51B2 corresponding to a high-pitched sound. That is, the distance h3 between the pivot center B1 of the black key 51B1 corresponding to the low-pitched sound and the black key 51B1 is greater than the distance h4 between the pivot center B2 of the black key 51B2 corresponding to the high-pitched sound and the black key 51B2.

In the case of the black key 51B1 and the white key 51W2 arranged in a direction directed from the low-pitched sound toward the high-pitched sound, the pivot center B1 of the bendable portion 60*b* for the black key 51B1 on the low-pitched-sound side is disposed farther from the black key 51B1 and the white key 51W2 in the key longitudinal direction M than the pivot center J2 of the bendable portion 60*b* for the white key 51W2 on the high-pitched-sound side. That is, the distance h3 between the pivot center B1 of the black key 51B1 on the low-pitched-sound side and the black key 51B1 is greater than the distance h2 between the pivot center J2 of the white key 51W2 on the high-pitched-sound side and the white key 51W2.

As described above, the pivot center of the bendable portion 60*b* for the key corresponding to the low-pitched sound is located farther from the key in the key longitudinal direction M of the key than the pivot center of the bendable portion 60*b* for the key corresponding to the high-pitched sound. Since the pivot center J of the key 51 corresponding to the low-pitched sound is far from the key 51, it is possible to achieve a touch feeling similar to that in a ground piano. This improves operability of the keyboard apparatus 100.

6.2. Coupler

The coupler 70 for the white key 51W1 and the coupler 70 for the black key 51B1 which are adjacent to each other are different from each other in position in the key longitudinal direction M. In other words, the coupler 70 for the white key 51W1 and the coupler 70 for the black key 51B1 which are adjacent to each other are respectively arranged at positions not overlapping each other in the scale direction S. This configuration reduces contact between the coupler 70 for the white key 51W1 and the coupler 70 for the black key 51B1 which are adjacent to each other.

The coupler 70 for the black key 51B1 is opposed to the bendable portion 60*b* for the white key 51W1 in the scale direction S. Thus, the coupler 70 for the black key 51B1 and the bendable portion 60*b* for the white key 51W1 are respectively arranged at positions spaced apart from each other at a predetermined distance, ensuring a large movable area of the coupler 70 for the black key 51B1. This results in improved stability of operation of the black key 51B1. This applies to the other black keys.

The coupler 70 for the white key 51W1 is opposed to the back narrow portion 8 of the black key 51B1 in the scale direction S. Here, as described above, the back narrow portion 8 (a connecting bendable portion) connects between the black key 51B1 (one of the plurality of keys) and the coupler 70. The back narrow portion 8 has a flat surface extending in a direction substantially orthogonal to the scale direction S and has flexibility.

The coupler 70 for the white key 51W1 and the back narrow portion 8 are opposed to each other and respectively arranged at positions spaced apart from each other at a predetermined distance, ensuring a large movable area of the coupler 70 for the white key 51W1. This results in improved stability of operation of the white key 51W1. This applies to the other white keys.

The coupler 70 for the black key 51B is provided farther from the key 51 in the key longitudinal direction M of the key 51 than the coupler 70 for the white key 51W. That is, the distance k3 between the coupler 70 for the black key 51B1 and the black key 51B1 is greater than the distance k4 between the coupler 70 for the white key 51W2 and the white key 51W2. With this configuration, the coupler 70 for the black key 51B can be disposed on the key-longitudinal-back-direction-M1 side of the coupler 70 for the white keys 51W. As a result, the coupler 70 for the black key 51B and the coupler 70 for the white key 51W are not adjacent to each other in the scale direction S, resulting in reduction in breakage and deterioration of the keyboard apparatus 100 due to contact between the couplers 70.

6.3. First Modification

Figure 7:
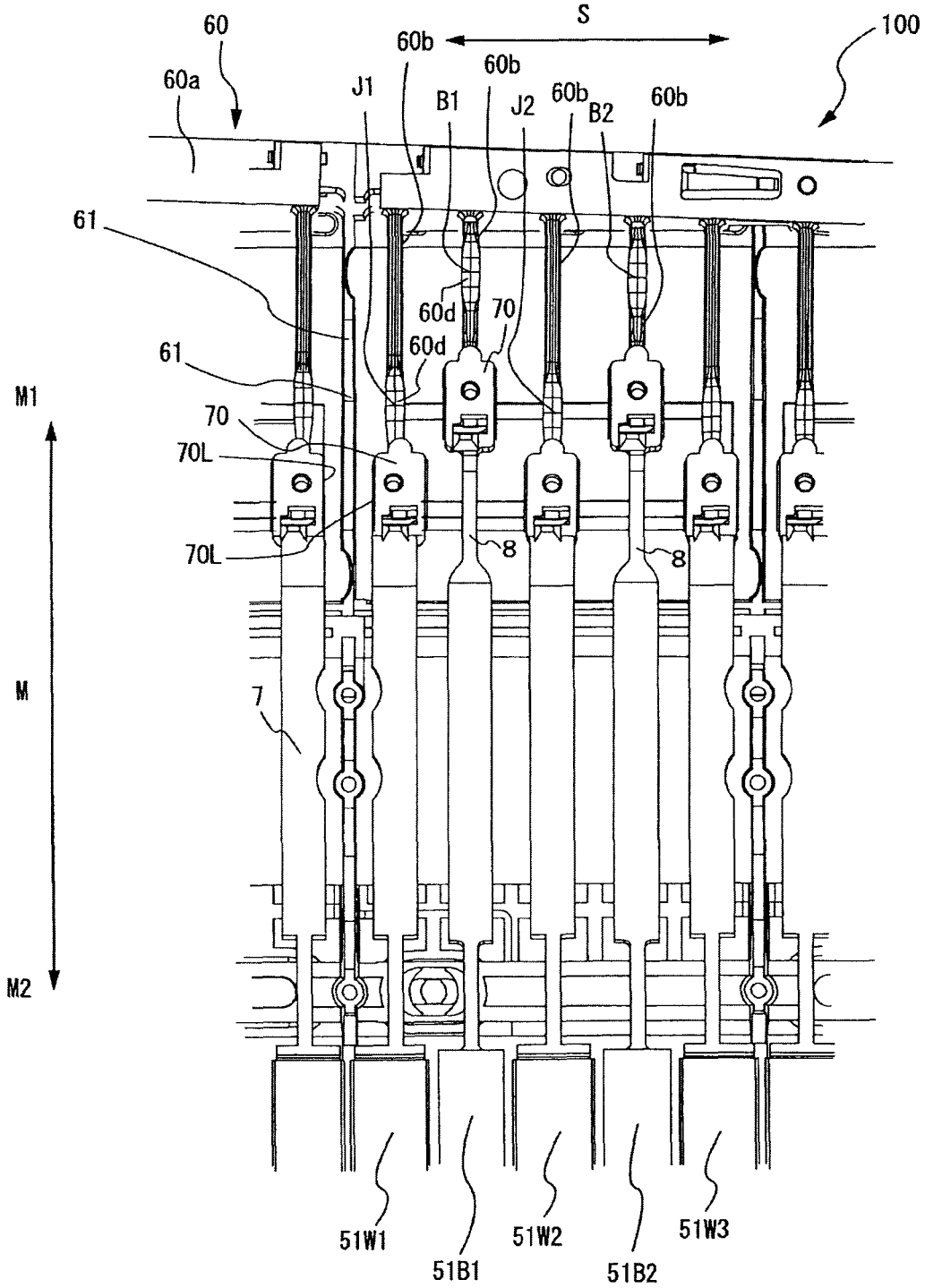
FIG. 7 is an enlarged view of a portion of a keyboard apparatus according to a modification of the embodiment of the present disclosure.

FIG. 7 is an enlarged view of a portion of the keyboard apparatus 100 according to a modification of the embodiment of the present disclosure. As illustrated in FIG. 7, the keyboard apparatus 100 according to the present modification includes a plate portion 61 between the connectors 52W of the respective white keys 51W. In this case, a surface 70L of the coupler 70 which faces the plate portion 61 may be flush with a side surface of the wide portion 7 (or the bendable portion 60*b*). Here, the wording "flush with" means that the surfaces are located within the same plane in the scale direction S. Here, the plate portion 61 is a portion of the frame 60 which supports the supporter 60*a* and extends in the key longitudinal direction M. It is noted that the couplers 70 for the other keys protrudes in the scale direction S beyond the wide portion 7.

The coupler 70 does not protrude in the scale direction S in order to make the distance between the surface 70L of the coupler 70 and the plate portion 61 in the scale direction S and the distance between the side surface of the wide portion 7 and the plate portion 61 in the scale direction S substantially equal to each other. Thus, the coupler 70 opposed to the plate portion 61 may be different in shape from the coupler 70 not opposed to the plate portion 61 among the plurality of couplers 70.

This configuration ensures a large distance between the coupler 70 and the plate portion 61. With this configuration, even in the case of the frame 60 having the plate portion 61, the coupler 70 for the white key 51W moving in the vertical direction E does not contact the plate portion 61.

6.4. Second Modification

Figure 10:
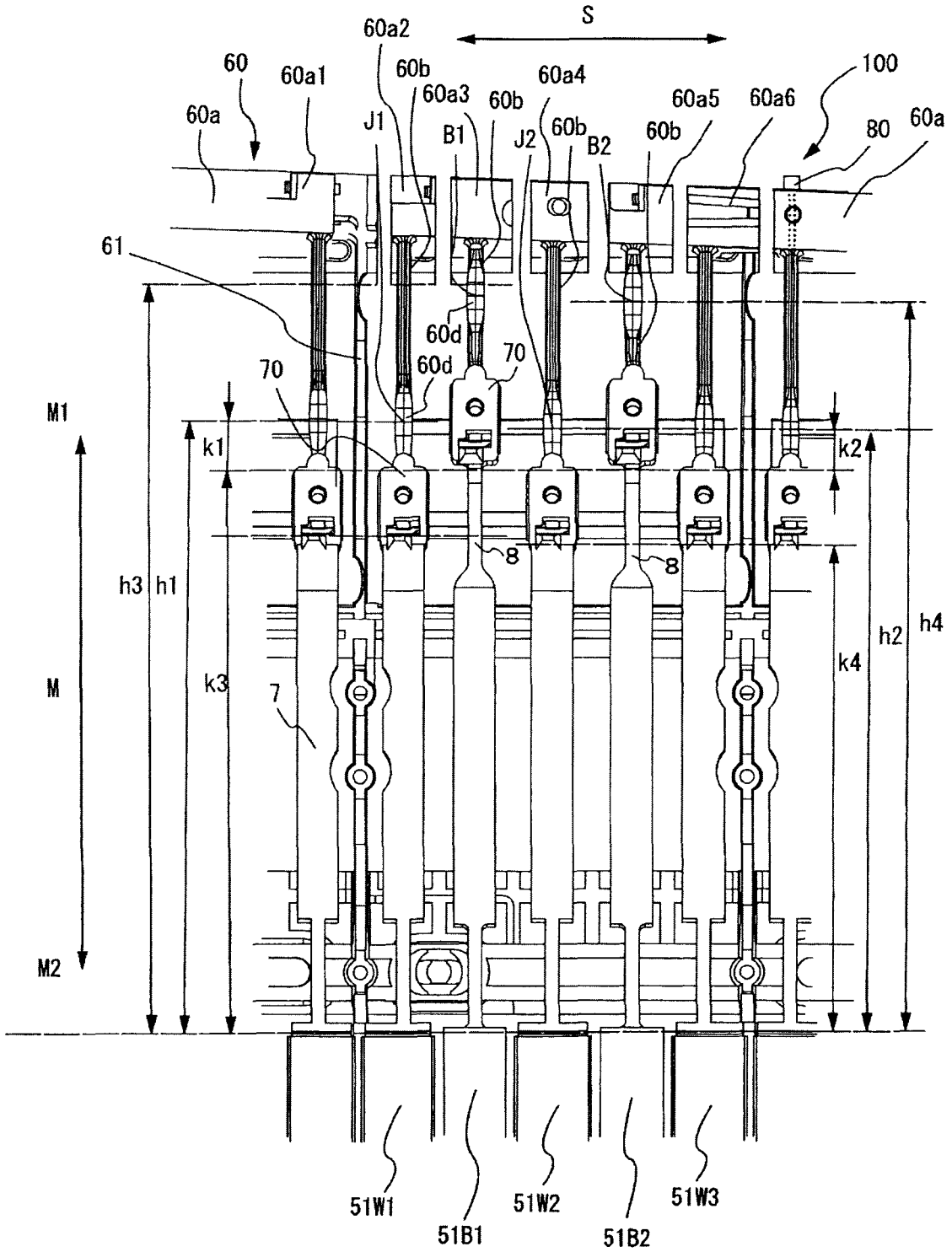
FIG. 10 is an enlarged view of a portion of a keyboard apparatus according to a modification.

FIG. 10 is an enlarged view of a portion of the keyboard apparatus 100 according to a modification. As illustrated in FIG. 10, the supporter 60*a* of the frame 60 may be divided into supporters 60*a*1-60*a*6. Thus, each of the supporters 60*a*1-60*a*6 may support a single key 51. In this case, at least one bendable portion 60*b* flexible in the scale direction S is disposed between each of the keys 51 and a corresponding one of the supporters 60*a*1-60*a*6. As illustrated in FIG. 2, the one supporter 60*a* may be configured to support two or more keys 51 such that a plurality of the bendable portions 60*b* are disposed between the supporter 60*a* and a plurality of keys 51. It is noted that a bolt 80 may be used such that the supporter 60*a* and the bendable portion 60*b* are attachable to and detachable from each other.

7. Hammer Mechanism

Figure 8A:
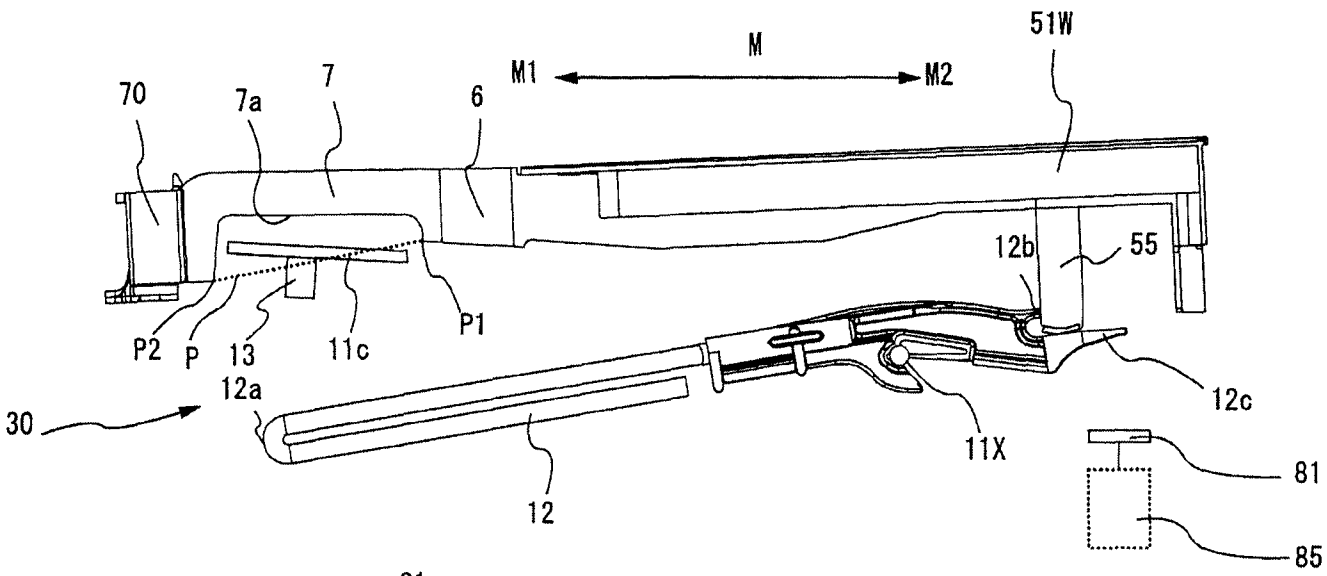
FIG. 8A is a side view indicating a positional relationship between the white key and a hammer when the white key is in a non-depressed state.
Figure 8B:
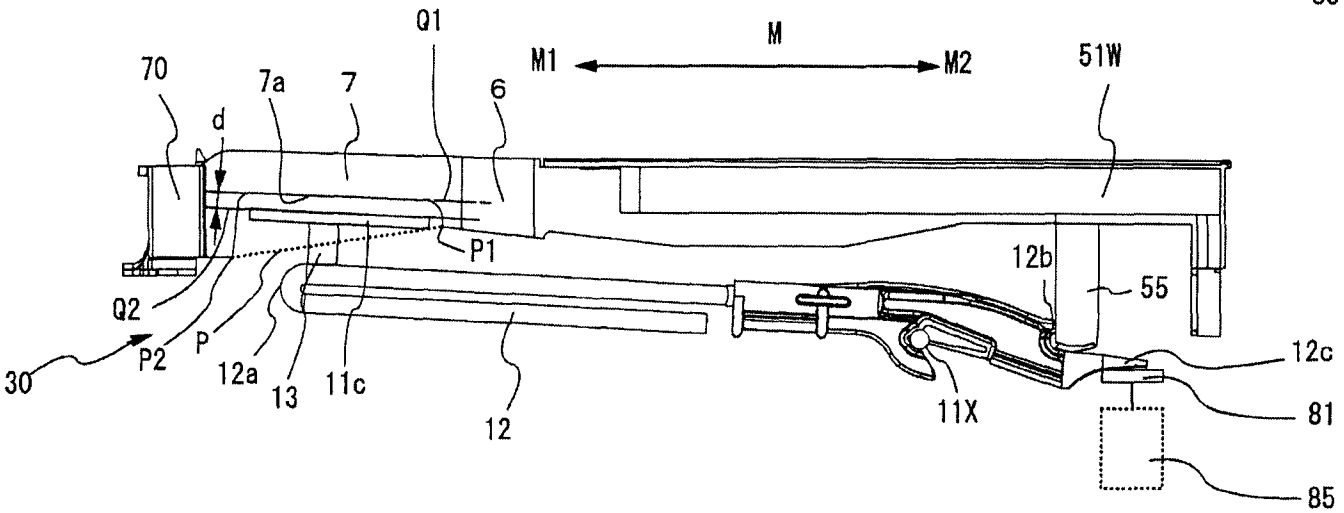
FIG. 8B is a side view indicating a positional relationship between the white key and the hammer when the white key is in a depressed state.

FIG. 8A is a side view illustrating a positional relationship between the white key 51W and the hammer 12 when the white key 51W is in the non-depressed state. FIG. 8B is a side view illustrating a positional relationship between the white key 51W and the hammer 12 when the white key 51W is in the depressed state. A hammer mechanism 30 includes: the hammer 12 configured to be operated in response to depression of the white key 51W; and the hammer stopper 13 configured to limit operation of the hammer 12. The hammer mechanism 30 further includes the support frame portion 11*c* and the supporter 14.

The above-described recessed portion 7*a* is recessed so as to avoid the hammer stopper 13 that contacts the hammer 12, and at least a portion of the support frame portion 11*c* supporting the hammer stopper 13.

The support frame portion 11*c* is disposed substantially parallel with the recessed portion 7*a* in the depressed state of the white key 51W (see FIG. 8B). In this state, the most-recessed surface of the recessed portion 7*a* indicated by an imaginary line Q1 and a surface of the support frame portion 11*c* indicated by an imaginary line Q2 are close at the distance d. Thus, in the case where the recessed portion 7*a* and the support frame portion 11*c* are configured so as to be located as close as possible when the white key 51W is depressed, a space under the key 51 can be used without any unnecessary portion, and an unnecessary space is reduced to the distance d. It is noted that the support frame portion 11*c* and the recessed portion 7*a* may not be parallel with each other as long as the support frame portion 11*c* and the recessed portion 7*a* are configured so as to be brought into closer to each other as possible.

The hammer 12 includes a sensor pressing portion 12*c* on the key-longitudinal-front-direction-M2-side of the pivot shaft 11X. A sensor 81 configured to detect depression (operation) of the key 51 is disposed under the sensor pressing portion 12*c*. There will be described the sensor 81 and a sound-source device 85 connected to the sensor 81.

Figure 9:
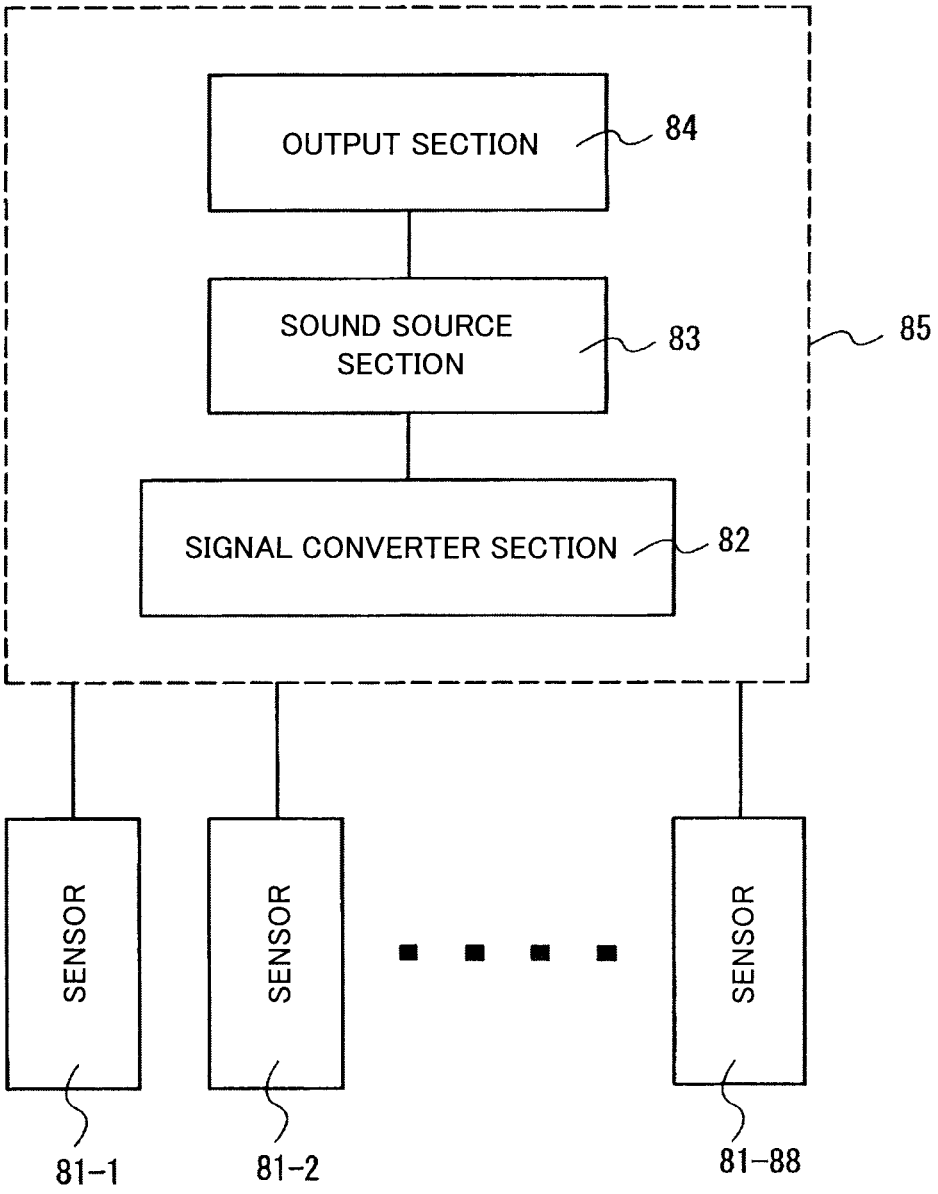
FIG. 9 is a block diagram illustrating a configuration of a sound-source device.

FIG. 9 is a block diagram illustrating a configuration of the sound-source device 85. The sound-source device 85 includes a signal converter section 82, a sound source section 83, and an output section 84. Sensors 81 are provided corresponding to the respective keys 100. Each of the sensors 81 detects an operation of a corresponding one of the keys 100 and outputs signals in accordance with the detection. In the present example, each of the sensors 81 outputs signals in accordance with three levels of key pressing amounts. The speed of the key pressing is detectable in accordance with a time interval between the signals.

The signal converter section 82 obtains the signals output from the sensors 81 (the sensors 81-1, 81-2, . . . , 81-88 corresponding to the respective 88 keys 100) and creates and outputs an operation signal in accordance with an operation state of each of the keys 100. In the present example, the operation signal is a MIDI signal. Thus, the signal converter section 82 outputs "Note-On" when a key is pressed. In this output, a key number indicating which one of the 88 keys 100 is operated, and a velocity corresponding to the speed of the key pressing are also output in association with "Note-On". When the player has released the key 100, the signal converter section 82 outputs the key number and "Note-Off" in association with each other. A signal created in response to another operation, such as an operation on a pedal, may be output to the signal converter section 82 and reflected on the operation signal.

The sound source section 83 creates the sound waveform signal based on the operation signal output from the signal converter section 82. The output section 84 outputs the sound waveform signal created by the sound source section 83. This sound waveform signal is output to the speaker 80 or a sound-waveform-signal output terminal, not illustrated, for example.

Returning to the explanation for FIG. 8, a portion of the hammer mechanism 30 is located at the recessed portion 7*a* of the wide portion 7 in the state in which the white key 51W is depressed as described above. The wordings "a portion of the hammer mechanism 30 is located at the recessed portion 7*a*" mean that a portion of the hammer mechanism 30 is located within a region enclosed by the recessed portion 7*a* and an imaginary line P connecting between one end portion P1 and the other end portion P2 of the recessed portion 7*a* in the key longitudinal direction M.

In the present embodiment, specifically, the hammer stopper 13 is disposed so as to be located at the recessed portion 7*a* of the wide portion 7 in the state in which the key 51 is depressed (see FIG. 8B). In the present embodiment, the hammer stopper 13 is disposed so as to be located at the recessed portion 7*a* of the wide portion 7 even in the state in which the key 51 is not depressed (see FIG. 8A). It is noted that, in the case where the key 51 is not depressed, even when the hammer stopper 13 is located at the recessed portion 7*a* of the wide portion 7, the hammer stopper 13 may be positioned at the recessed portion 7*a* of the wide portion 7 after the key 51 is depressed.

The hammer stopper 13 has a function of limiting an upper-limit position of the distal end portion 12*a* of the hammer 12 when the white key 51W is depressed by the player. Since the hammer 12 is brought into contact with the hammer stopper 13, when the white key 51W is depressed by the player, the player is given a feeling of depression of the key 51 as in a ground piano.

In the configuration in the present embodiment, the couplers 70 (the connectors) are provided at different positions in the key longitudinal direction M of the key 51, whereby the couplers 70 are not adjacent to each other in the scale direction S. This configuration reduces contact between the couplers 70 in the case where the key 51 is moved in the scale direction S. This results in improved stability of operation of the key 51.

In the above-described configuration in the present embodiment, the recessed portion 7*a* is formed in the connector 52. When the white key 51W or the black key 51B is depressed, the hammer 12 of the hammer mechanism 30 can be moved toward the recessed portion 7*a*. The recessed portion 7*a* formed in the connector 52 for the white key 51W or the black key 51B can be used as a space for receiving the hammer stopper 13 and a space into which the distal end portion 12*a* of the hammer 12 is moved. This configuration reduces the size of the electronic keyboard instrument 500 in the vertical direction E and ensures a large movable range of the hammer 12. Also, a heavy touch of the key 51 is achieved.

In the configuration in the present embodiment, the flexibility of the front narrow portion 6 and the back narrow portion 8 is maintained, and the stiffness of the connector 52 in the vertical direction E is maintained.

Configurations with constituent elements added, deleted, or changed in design or with steps added, omitted, or changed in condition by those skilled in the art based on the configuration explained as the embodiment of the present disclosure are also included in the scope of the present disclosure as long as the configurations contain the spirit of the present disclosure.

Even in the case where effects different from the effects achieved by the above-described embodiment are achieved, when the effects are obvious from the description of the present specification or easily predictable by those skilled in the art, the effects are interpreted as being achieved by the present disclosure.

What is claimed is:

1. A keyboard apparatus, comprising:

a plurality of keys arranged along a scale direction with the plurality of keys each extending in a longitudinal direction of the keys different from the scale direction;

at least one frame configured to support at least one key of the plurality of keys;

at least one bendable portion disposed between the at least one key and the frame and having flexibility in the scale direction; and a coupler configured to couple the at least one bendable portion and the at least one key to each other attachably and detachably, wherein a first coupler, which couples a first key to a first bendable portion disposed between the first key and the frame, and a second coupler, which couples a second key, adjacent to the first key, to a second bendable portion disposed between the second key and the frame, are disposed respectively at positions different from each other in the longitudinal direction of the keys, wherein a narrow portion extends from the second coupler toward the second key in the longitudinal direction of the keys, the narrow portion having a width, in the scale direction, less than a width, in the scale direction, of the second coupler, and wherein the first coupler is opposed to the narrow portion in the scale direction.

2. The keyboard apparatus according to claim 1, wherein the first bendable portion has a flat surface extending in a direction substantially orthogonal to the scale direction, and wherein the second coupler is opposed, in the scale direction, to the first bendable portion.

3. The keyboard apparatus according to claim 1, wherein a distance, in the longitudinal direction of the keys, between the second coupler and the second key is greater than a distance, in the longitudinal direction of the keys, between the first coupler and the first key.

4. The keyboard apparatus according to claim 1, wherein the coupler is attached and detached by a sliding movement thereof with the at least one bendable portion.

5. The keyboard apparatus according to claim 4, wherein the sliding movement is movement in an up and down direction.

6. The keyboard apparatus according to claim 1, wherein a distance, in the longitudinal direction of the keys, between a black key and a coupler corresponding to the black key is greater than a distance, in the longitudinal direction of the keys, between a white key and a coupler corresponding to the white key.

7. The keyboard apparatus according to claim 1, wherein the frame comprises: a supporter configured to support the bendable portion and extend in the scale direction; and a plate portion supported by the supporter and extending in the longitudinal direction of the keys, and wherein one of a plurality of the couplers which is opposed to the plate portion has a shape different from that of another of the plurality of the couplers which is not opposed to the plate portion.

8. The keyboard apparatus according to claim 1, wherein the at least one bendable portion has flexibility in a pivotal direction of the at least one key.

9. The keyboard apparatus according to claim 1, wherein a distance, in the longitudinal direction of the keys, between a key for a low-pitched sound and a pivot center of a bendable portion corresponding to the key for the low-pitched sound is greater than a distance, in the longitudinal direction of the keys, between a key for a high-pitched sound and a pivot center of a bendable portion corresponding to the key for the high-pitched sound.

10. The keyboard apparatus according to claim 1, wherein the plurality of keys comprise a third key and a fourth key having an identical shape, and wherein a distance between a coupler corresponding to the third key and a pivot center of the third key is different from a distance between a coupler corresponding to the fourth key and a pivot center of the fourth key.

11. An electronic keyboard instrument, comprising:

a keyboard apparatus comprising (i) a plurality of keys arranged along a scale direction with the plurality of keys each extending in a longitudinal direction of the keys different from the scale direction, (ii) at least one frame configured to support at least one key of the plurality of keys, (iii) at least one bendable portion disposed between the at least one key and the frame and having flexibility in the scale direction, and (iv) a coupler configured to couple the at least one bendable portion and the at least one key to each other attachably and detachably, wherein a first coupler, which couples a first key to a first bendable portion disposed between the first key and the frame, and a second coupler, which couples a second key, adjacent to the first key, to a second bendable portion disposed between the second key and the frame, are disposed respectively at positions different from each other in the longitudinal direction of the keys;

a sensor configured to detect an operation of the key; and a sound source section configured to produce a sound waveform signal in response to a signal output by the sensor, wherein a narrow portion extends from the second coupler toward the second key in the longitudinal direction of the keys, the narrow portion having a width, in the scale direction, less than a width, in the scale direction, of the second coupler, and wherein the first coupler is opposed to the narrow portion in the scale direction.

* * * * *